US005378373A

United States Patent [19]

Hollander

[11] Patent Number: 5,378,373

[45] Date of Patent: Jan. 3, 1995

[54] TRANSPORT AND DEPOSIT INHIBITION OF COPPER IN BOILER SYSTEMS

[75] Inventor: Orin Hollander, Warwick, Pa.

[73] Assignee: Betz Laboratories, Inc., Trevose, Pa.

[21] Appl. No.: 198,171

[22] Filed: Feb. 17, 1994

[51] Int. Cl.[6] ..... C02F 5/12

[52] U.S. Cl. ..... 210/698; 252/391; 422/16

[58] Field of Search ..... 210/698; 252/391, 392, 252/394–396; 422/16

[56] References Cited

U.S. PATENT DOCUMENTS

| | | | |
|---|---|---|---|
| 2,888,399 | 5/1959 | Wirtel et al. | 252/391 |
| 4,149,969 | 4/1979 | Robitaille et al. | 252/391 |
| 4,315,889 | 2/1982 | Mc Chesney et al. | 252/391 |
| 4,657,785 | 4/1987 | Kelly et al. | 427/255.6 |
| 4,668,474 | 5/1987 | Gill et al. | 252/391 |
| 4,675,158 | 6/1987 | Klindera | 252/391 |
| 4,719,036 | 1/1988 | Clubley et al. | 252/391 |
| 4,734,203 | 3/1988 | Lin et al. | 210/698 |
| 5,158,684 | 10/1992 | Moulton et al. | 210/698 |
| 5,217,686 | 6/1993 | Vanderpool et al. | 210/696 |

*Primary Examiner*—Neil McCarthy
*Attorney, Agent, or Firm*—Alexander D. Ricci; Philip H. Von Neida

[57] ABSTRACT

This invention relates to a method of transporting and inhibiting the deposition of copper and copper-containing metals on metal surfaces in steam generating systems. This method utilizes a sulfono benzotriazole compound or salt thereof as the treatment agents.

12 Claims, No Drawings

TRANSPORT AND DEPOSIT INHIBITION OF COPPER IN BOILER SYSTEMS

FIELD OF THE INVENTION

The present invention relates to methods for inhibiting the corrosion of metal surfaces in contact with the aqueous system of a steam generating system. More particularly, this invention pertains to methods of inhibiting the corrosion of metal in steam generating systems by utilizing in the aqueous system a sulfono benzotriazole compound or salt thereof.

BACKGROUND OF THE INVENTION

The corrosion, transport and deposition of copper and copper-based metals in steam generating systems has been the subject of increasing concern in the industrial boiler marketplace. The copper corrosion in these systems is primarily caused by the presence of dissolved oxygen, carbon dioxide, ammonia and uncontrolled pH. Copper oxides are released as particulate oxides, soluble Cu(I)/Cu(II) and metallic copper species. Copper oxides are relatively unstable and can dissolve, break-up and continually re-deposit within a boiler system.

The consequences of such copper corrosion are the loss of metal potentially leading to failure or requiring expensive maintenance, transport of copper corrosion products to the boiler surfaces, leading to decreased heat transfer and loss of productivity, and depositing of copper metal on less noble metal surfaces causing galvanic corrosion. Copper discharge is also a health and environmental concern due to its toxicity.

Accordingly, it is common practice to introduce corrosion inhibitors into the boiler system. These materials interact with the metal to directly produce a film which is resistant to corrosion, or to indirectly promote formation of protective films by activating the metal surface so as to form stable oxides or other insoluble salts. However, unlike ferrous metals which form insoluble, protective oxides, copper alloys form oxides that are non-protective, allowing further corrosion of the underlying metal to continue.

DESCRIPTION OF THE RELATED ART

Chelants have shown effectiveness as corrosion inhibitors in boiler system treatments. Nitrilo triacetic acid and EDTA were generally considered the most suitable boiler water treatment chelants. U.S. Pat. No. 4,657,785 teaches the use of benzotriazole and/or tolyltriazole to reduce copper corrosion in boiler condensate systems. The triazole compound complexes with the copper to form a film which acts as a corrosion barrier. However, it is not taught to complex copper and then transport the complex out of the boiler system.

U.S. Pat. No. 4,734,203 discloses the use of (piperazine methyl-para-hydroxysulfonic acid)$_n$ and (piperazine methyl-para-hydroxybenzoic acid)$_n$ where n is 2 to 20 to chelate and transport copper ions in boiler water. U.S. Pat. No. 5,158,684 teaches methods for transporting and inhibiting the deposition of copper metals on heat transfer surfaces in steam generating systems. Thermally stable chelants and carboxylated polymeric dispersants are utilized in conjunction to inhibit copper induced corrosion.

DETAILED DESCRIPTION OF THE INVENTION

The present invention relates to methods of transporting and inhibiting the deposition of copper and copper-containing metals on metal surfaces in contact with an aqueous medium in steam generating systems comprising adding to said aqueous system a sulfono benzotriazole compound or salt thereof.

The methods of the present invention prove effective at facilitating the transportation and inhibiting the deposition of copper and copper-containing metals in steam generating systems. The sulfono benzotriazole compounds complex with copper (I) and copper (II) ions that are present in the boiler water. These ions enter the boiler feedwater via corrosion of copper-bearing metallurgies in the condensate system. These copper ions form deposits in the boiler, leading to poor performance and metal corrosion. The copper ions can also galvanically deposit on less noble ferrous metal surfaces and initiate a galvanic corrosion cell, leading to ferrous metal corrosion. The copper ions can further impinge on other metal surfaces and cause corrosion by erosion of the surfaces. The water soluble complex formed by the sulfono benzotriazole compounds and the copper ions keeps the ions from depositing and transports them through the boiler system and out via blowdown.

The sulfono benzotriazole compounds have the formula:

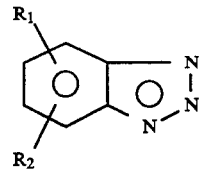

wherein $R_1$ and $R_2$ are each independently H, $C_1$ to $C_6$ alkyl, alkoxy, or halide, with the proviso that at least one of $R_1$ or $R_2$ be $SO_3H$, $SO_3M$, $R_3SO_3H$ or $R_3SO_3M$, wherein $R_3$ is a $C_1$ to $C_6$ alkyl group and M is an alkali metal or alkaline earth metal.

The preferred sulfono benzotriazole compounds are those where $R_1$ is $SO_3M$ and $R_2$ is a $C_1$ to $C_6$ alkyl group. Preferred among these are when $R_1$ is $SO_3Na$ and $R_2$ is methyl, designated the sodium salt of 5-sulfono tolyltriazole.

The total amount of sulfono benzotriazole compound used in the methods of the present invention is that amount which is sufficient to complex with the copper present in the aqueous system of the boiler. An increase in copper ion concentration can result from higher sulfide concentrations and the presence of other corrosive agents. As such, larger amounts of sulfono benzotriazole compounds need be added to the aqueous system of the boiler.

Generally, the sulfono benzotriazole compound is added to the boiler in a range from about 1 part to about 10 parts per million for every part per million of copper ion present with a broader range of 0.1 part to about 100 parts per million parts copper ion contemplated. Preferably, the sulfono benzotriazole compound is added in excess of 3.7 pads per million for every part per million of copper ion present. Combinations of two or more sulfono benzotriazole compounds may be added to the boiler along similar dosages.

The sulfono benzotriazole can be applied to the aqueous system of the boiler in any conventional manner and can be fed to the aqueous system neat or in any suitable solvent means. Water, glycol and polyglycols can be employed as the solvent. The sulfono benzotriazole is preferably added as an aqueous solution in either a continuous or intermittent fashion.

The present invention can be applied in a boiler water treatment program with other commonly used treatment agents. These can include but are not limited to: neutralizing or filming amines; oxygen scavengers; corrosion inhibitors and the like.

The inventive treatment is not affected by the pH of the system, and will be effective at any boiler pH that is used in industry.

The use of the sulfono benzotriazole compound proved effective in high pressure boilers operating in excess of 900 psig but is effective at pressures below this.

This invention will now be further described with respect to a number of specific examples which are to be regarded solely as illustrative, and not as restricting the scope of the invention.

EXAMPLES

Tolyltriazole sulfonic acid (TTASA) and benzotriazole sulfonic acid (BZTSA) were examined in research boiler tests versus a known copper chelant, phenanthroline.

Research Boiler Runs

Research boilers were fired with electric heated probes at a heat flux of 376 w/in$^2$. The boilers were operated for 44 hours in duration and the steaming and blowdown rates were maintained at constant rates to achieve the required number of cycles of operation.

Deposit weight density (DWD) was used as the primary indicator of product effectiveness. DWDs were determined analytically by removing the deposit from the heated probes by soaking in a hydrochloric acid solution and then scraped mechanically. Blowdown (BLD) compositions were used as the indicators of the amount of metal transported out of the boiler.

The results of this research boiler testing are presented in Tables I and II.

TABLE I

Research boiler run
Coordinated phosphate/pH (PPH) program feedwater at 15 cycles
6 ppm Cu, 3 ppm Fe, 1 ppm PMA, 600 psig.

| Run No. | Chelant | Dosage (ppm) | Actives (ppm) | Avg DWD (g/ft$^2$) | BLD Cu (ppm) | BLD Fe (ppm) |
|---|---|---|---|---|---|---|
| 1 | none | 0.0 | 0.0 | 0.81 | 1.18 | 0.40 |
| 2 | PHEN | 15.0 | 15.0 | 6.40 | 5.31 | 0.07 |
| 3 | BZTSA | 15.0 | 0.72 | 0.55 | 2.10 | 0.53 |
| 4 | TTASA | 15.0 | 0.34 | 0.89 | 5.58 | 0.05 |
| 5* | TTASA | 19.6 | 19.60 | 0.12 | 2.34 | 0.03 |

*Run at 900 psig with 2 ppm Cu and 1 ppm Fe
PHEN = phenanthroline
BZTSA = benzotriazole sulfonic acid
TTASA = tolyltriazole sulfonic acid
PMA = poly(meth)acrylic acid Both BZTSA and TTASA both compare favorably with a known copper chelant, phenanthroline. TTASA particularly exhibited good deposit control characteristics and good transport. Table II reports more of the same testing performed at higher pressures.

TABLE II

Research boiler run
Coordinated phosphate/pH (PPH) program feedwater at 15 cycles
6 ppm Cu, 3 ppm Fe, 1 ppm PMA, 1450 psig.

| Run No. | Chelant | Dosage (ppm) | Actives (ppm) | Avg DWD (g/ft$^2$) | BLD Cu (ppm) | BLD Fe (ppm) |
|---|---|---|---|---|---|---|
| 1* | TTASA | 19.6 | 19.6 | 0.24 | 1.88 | 0.03 |
| 2 | none | 0.0 | 0.0 | 3.70 | 0.07 | 0.03 |
| 3 | none | 0.0 | 0.0 | 6.25 | 0.11 | 0.04 |
| 4 | PHEN | 15.0 | 15.0 | 3.90 | 2.14 | 0.12 |
| 5 | PHEN | 15.0 | 15.0 | 3.10 | 2.26 | 0.06 |
| 6 | BZTSA | 15.0 | 0.72 | 2.41 | 0.64 | 0.04 |
| 7 | TTASA | 15.0 | 0.34 | 1.63 | 1.41 | 0.02 |

*Run at 1200 psig with 2 ppm Cu and 1 ppm Fe
PHEN = phenanthroline
BZTSA = benzotriazole sulfonic acid
TTASA = tolyltriazole sulfonic acid
PMA = poly(meth)acrylic acid The results reported in Table II show that the inventive compounds prove effective at both copper transport and deposition inhibition in high temperature boiler systems. TTASA proved more effective than phenanthroline at deposit control and similar effectiveness at copper transport in high pressure boilers.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what I claim is:

1. A method of transporting and inhibiting the deposition of copper and copper-containing metals on metal surfaces in contact with an aqueous medium in steam generating systems comprising adding to said aqueous system from 0.1 part to about 100 parts per million parts of a sulfono benzotriazole compound of salt thereof.

2. The method as claimed in claim 1 wherein said sulfono benzotriazole has the formula:

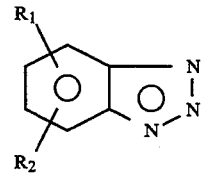

wherein $R_1$ and $R_2$ are each independently H, $C_1$ to $C_6$ alkyl, alkoxy, or halide, with the proviso that at least one of $R_1$ or $R_2$ be $SO_3H$, $SO_3M$, $R_3SO_3H$ or $R_3SO_3M$, wherein $R_3$ is a $C_1$ to $C_6$ alkyl group and M is an alkali metal or alkaline earth metal.

3. The method as claimed in claim 1 wherein said $R_1$ is $SO_3M$ and said $R_2$ is $C_1$ to $C_6$ alkyl group.

4. The method as claimed in claim 3 wherein said sulfono benzotriazole is the sodium salt of 5-sulfono tolyltriazole.

5. The method as claimed in claim 2 wherein said sulfono benzotriazole is benzotriazole sulfonic acid.

6. The method as claimed in claim 3 wherein said sulfono benzotriazole is tolyltriazole sulfonic acid.

7. The method as claimed in claim 1 wherein said sulfono benzotriazole is added to said aqueous medium with other treatment agents selected from the group consisting of neutralizing and filming amines, oxygen scavengers and corrosion inhibitors.

8. The method as claimed in claim 1 wherein said sulfono benzotriazole compound is added to said aqueous system in an amount of about 3.7 parts per million per every part per million of said copper.

9. The method as claimed in claim 1 wherein 2 or more sulfono benzotriazole compounds are added to said aqueous system in conjunction.

10. The method as claimed in claim 1 wherein said sulfono benzotriazole compound is added to said aqueous system in a solvent.

11. The method as claimed in claim 9 wherein said solvent is water.

12. The method as claimed in claim 1 wherein said metal surfaces are ferrous metal surfaces.

* * * * *